United States Patent [19]

Wofford

[11] Patent Number: 4,893,360

[45] Date of Patent: Jan. 16, 1990

[54] APPARATUS FOR POSITIONING A SEAT ON THE RIM OF A TOILET BOWL

[76] Inventor: Barry Wofford, 1102 Parkside Blvd., Toledo, Ohio 43607

[21] Appl. No.: 303,759

[22] Filed: Jan. 30, 1989

[51] Int. Cl.[4] ..... A47K 13/00

[52] U.S. Cl. ..... 4/237; 4/234; 4/248; 297/193

[58] Field of Search ..... 4/234, 235, 236, 237, 4/239, 248; 297/193

[56] References Cited

U.S. PATENT DOCUMENTS

| | | | |
|---|---|---|---|
| 115,214 | 5/1871 | Jones | 4/237 X |
| 860,540 | 7/1907 | Hammann et al. | 4/237 |
| 1,557,919 | 10/1925 | Zundel | 4/235 |
| 1,588,019 | 6/1926 | Gitter | 4/237 |
| 1,910,736 | 5/1933 | Arthur | 4/DIG. 8 X |
| 2,050,472 | 8/1936 | Steadman | 4/234 |
| 2,564,338 | 8/1951 | McCarroll | 297/193 |
| 2,919,169 | 12/1959 | Jackson | 297/193 |
| 3,646,620 | 3/1972 | McCawley | 4/237 |
| 3,863,277 | 2/1975 | Harrison | 4/237 |
| 4,747,167 | 5/1988 | Adams | 4/234 |

FOREIGN PATENT DOCUMENTS

| | | | |
|---|---|---|---|
| 375167 | 6/1932 | United Kingdom | 4/237 |
| 573004 | 11/1945 | United Kingdom | 4/239 |
| 616403 | 1/1949 | United Kingdom | 4/237 |

*Primary Examiner*—Henry J. Recla
*Assistant Examiner*—R. M. Fetsuga
*Attorney, Agent, or Firm*—MacMillan, Sobanski & Todd

[57] ABSTRACT

An apparatus for positively positioning a seat on the rim of a toilet bowl to prevent the seat from accidently sliding off of the rim is disclosed. A first plurality of positioning members is attached to the upper surface of the rim, while a second plurality of positioning members is attached to the lower surface of the seat. The first and second pluralities of positioning members are formed having complementary male and female shapes and are located such that they engage one another when the seat is lowered onto the rim. When so engaged, the positioning members prevent the seat from sliding laterally relative to the rim. The male positioning members are preferably formed having the shape of a truncated cone, while the female positioning members are preferably formed having a complementary shaped recess. Adhesive tape may be used to attach the positioning members to the seat and the rim.

11 Claims, 1 Drawing Sheet

APPARATUS FOR POSITIONING A SEAT ON THE RIM OF A TOILET BOWL

BACKGROUND OF THE INVENTION

This invention relates in general to devices for locating movable articles relative to one another and in particular to an apparatus for positively positioning the seat of a toilet on the rim of a toilet bowl.

Toilets are well known structures which typically include a large hollow bowl having a seat pivotably attached thereto. The upper open end of the bowl, commonly referred to as the rim, is provided with a flat circular upper surface. The toilet seat is pivotably attached to the bowl so as to be movable between a lowered position, wherein the lower surface of the seat rests horizontally upon the flat upper surface of the rim, and a raised position, wherein the seat is oriented vertically. Most toilet seats are provided with a plurality of protuberances on the lower surface thereof. The protuberances are adapted to engage the upper surface of the rim when the seat is in the lowered position.

Generally, the pivotable connection between the bowl and the seat is accomplished by means of a hinge, one portion of which is secured to the bowl by threaded fasteners or other comparable means. When the threaded fasteners are tighted, the hinge and the seat are positioned such that the protuberances formed on the lower surface of the seat will engage the upper surface of the rim when lowered thereon. After repeated use, however, the threaded fasteners may loosen, causing the hinge and the seat to be moved laterally relative to the rim such that the protuberances do not engage the rim when the seat is lowered. Worse yet, the protuberances may initially engage the rim when the seat is lowered, but may slide laterally off of the rim when a person sits upon the seat. This situation is not only annoying and likely to damage the seat or the rim, but it is potentially dangerous to the person.

SUMMARY OF THE INVENTION

This invention relates to an apparatus for positively positioning a seat on the rim of a toilet bowl to prevent the seat from accidently sliding off of the rim. A first plurality of positioning members is attached to the upper surface of the rim, while a second plurality of positioning members is attached to the lower surface of the seat. The first and second pluralities of positioning members are formed having complementary male and female shapes and are located such that they engage one another when the seat is lowered onto the rim. When so engaged, the positioning members prevent the seat from sliding laterally relative to the rim. The male positioning members are preferably formed having the shape of a truncated cone, while the female positioning members are preferably formed having a complementary shaped recess. A suitable adhesive means, such as double-faced adhesive tape, may be used to attach the positioning members to the seat and the rim.

It is an object of this invention to provide an apparatus for positively positioning a seat on the rim of a toilet bowl to prevent the seat from accidently sliding off of the rim.

It is a further object of this invention to provide such a positioning apparatus which is simple and inexpensive in construction and operation.

Other objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
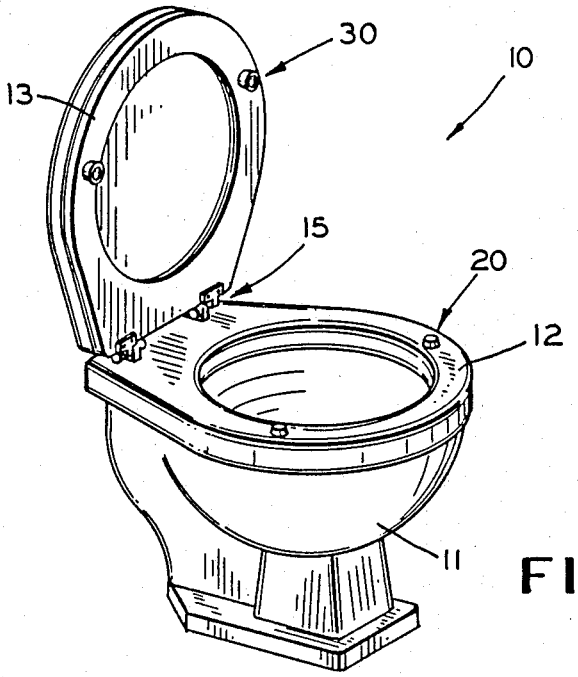
FIG. 1 is a perspective view of a toilet having a plurality of positioning members attached to the seat and rim thereof in accordance with this invention.

Referring now to the drawings, there is illustrated in FIG. 1 a conventional toilet, indicated generally at 10. The toilet 10 includes a enlarged bowl 11 having an upper open end. A rim 12 is defined about the upper open end of the bowl 11. The upper surface of the rim 12 is flat and circular in shape. A seat 13 is pivotably secured to the bowl 11 by a conventional hinge assembly, indicated generally at 15. As is well known, the hinge assembly 15 permits the seat 13 to be pivoted relative to the bowl 11 from a raised position, illustrated in FIGS. 1 and 2, to a lowered position, illustrated in FIG. 3.

Figure 2:
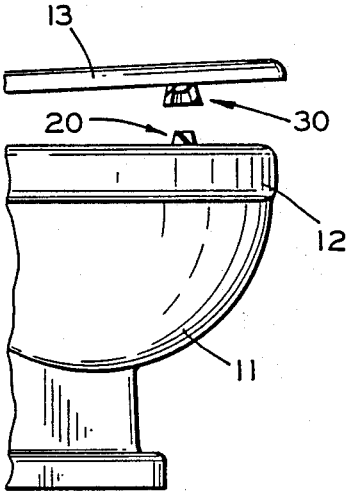
FIG. 2 is a side elevational view of the toilet illustrated in FIG. 1, the seat of the toilet being shown in a raised position.
Figure 4:
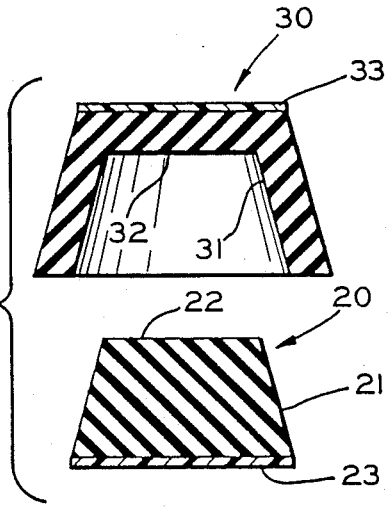
FIG. 4 is an enlarged sectional view of one pair of the positioning members shown in FIGS. 1 through 3.

A first plurality of positioning members, indicated generally at 20, is attached to the upper surface of the rim 12. As best shown in FIGS. 2 and 4, each of the first positioning members 20 is formed in the shape of a truncated cone, having a tapered side wall 21 and a flat end surface 22. Means are provided for adhering the first positioning members 20 to the rim 12. As shown in FIG. 4, a strip of conventional double sided adhesive tape 23 is used to attach the first positioning members 20 to the rim 12. However, other similar means may be used. A second plurality of positioning members, indicated generally at 30, is attached to the lower surface of the seat 13. As best shown in FIGS. 2 and 4, the second positioning members 30 are solid pieces having recesses formed therein. The shapes of the recesses are complementary to the shapes of the first positioning members 20 (i.e., in the form of a truncated cone), each having a tapered side wall 31 and a flat end surface 32. A strip of double sided adhesive tape 33 may be used to attach each of the second positioning members 30 to the lower surface of the seat 13.

Figure 3:
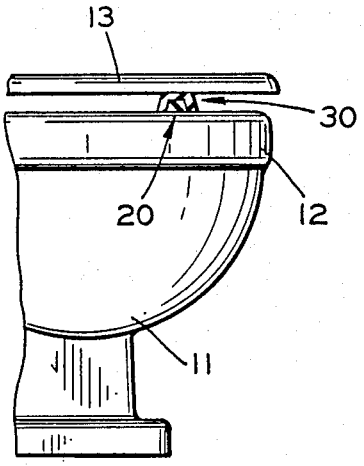
FIG. 3 is a side elevational view similar to FIG. 2 showing the seat in a lowered position.

The first and second positioning members 20 and 30 can be located in any desired location on the rim 12 and the seat 13, respectively. However, as shown in FIGS. 2 and 3, such first and second positioning members 20 and 30 should be located relative to one another such that the first positioning members 20 are received within the second positioning members 30 when the seat 13 is lowered onto the rim 12. When so received, the end surfaces 22 and 32 engage one another, thereby supporting the seat 13 above the rim 12. It can be seen that the axes of the truncated cones defined by the positioning members 20 and 30 are co-axial when the the first positioning members are received within the second positioning members. Because the the positioning members 20 and 30 are attached to the rim 12 and the seat 13, respectively, the seat 13 is securely positioned on the rim 12 when the seat 13 is lowered thereon. The cooperation of the positioning members 20 and 30 prevents any lateral movement of the seat 13 relative to the rim 12, such as might occur if the hinge assembly 15 were to become loosened.

The tapered side walls 21 and 31 of the positioning members 20 and 30, respectively, automatically align the seat 13 properly with respect to the rim 12 as it is lowered thereon. Such automatic alignment occurs because the side walls 21 and 31 initially engage one another as the seat 13 is lowered if the axes of the respective truncated cones are not co-axially aligned. As the mis-aligned seat 13 is further lowered, the side walls 21 and 31 guide the seat 13 into proper co-axial alignment until the end surfaces 22 and 32 engage one another.

Although the invention has been described and illustrated with two pairs of the positioning members 20 and 30, it is contemplated that additional pairs may be used if desired. Furthermore, it may be desirable to use only one of the first positioning members 20 in conjunction with one of the second positioning members 30. Such an arrangement might be appropriate where the seat 13 is already provided with one or more conventional protuberances (not shown) integrally formed on the lower surface thereof for engaging the rim 12 and supporting the seat 13 thereon. Since such protuberances already support the seat 13 on the rim 12, the single pair of positioning members 20 and 30 may be used solely for positioning purposes, and not for supporting the seat 13 on the rim 12.

The positioning members 20 and 30 are easily installed in initially aligned positions by the following steps. First, the first positioning members 20 are attached to the rim 12 in the desired positions by means of the adhesive tapes 23. Next, the second positioning members 30 are placed on top of the first positioning members 20 such that the upper adhesive tapes 33 thereon are exposed. Lastly, the seat 13 is carefully lowered onto the positioning members 20 and 30 in the desired position relative to the rim 12. When the seat 13 engages the exposed adhesive tapes 33 on the second positioning members 30, they will become attached thereto. The seat 13 can then be raised and lowered for use as described above.

Figure 5:
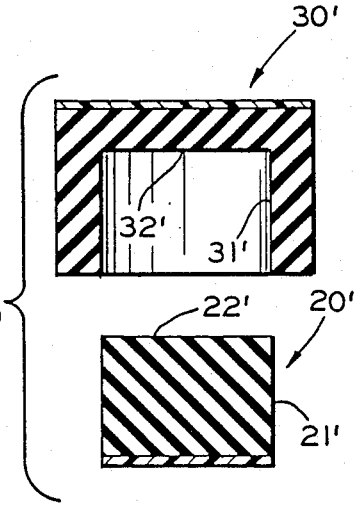
FIG. 5 is an enlarged sectional elevational view similar to FIG. 4 showing an alternate embodiment of the positioning members.

FIG. 5 illustrated an alternative embodiment of the invention. As shown therein, a first positioning member 20' is cylindrical in shape, including a perpendicular side wall 21' and a flat end surface 22'. Similarly, a second positioning member 30' has a cylindrical recess formed therein, including a perpendicular side wall 31' and a flat end surface 32'. The positioning members 20' and 30' function in the same manner as the the positioning members 20 and 30 described above. The upper edge between the side wall 21' and the end surface 22' of the first positioning member 20' may be rounded to facilitate its entry within the second positioning member 30' when the seat is slightly mis-aligned.

In accordance with the provisions of the patent statutes, the principle and mode of operation of the invention have been described and illustrated in its preferred embodiment. However, it must be understood that the invention may be practiced otherwise than as specifically explained and illustrated without departing from its spirit or scope.

What is claimed is:

1. For use with a toilet having a bowl defining a rim having an upper surface, and a seat pivotably attached to the bowl, the seat having a lower surface and being movable to a lowered position wherein the lower surface of the seat rests upon the upper surface of the rim, an apparatus for positioning the seat relative to the rim comprising:

a first positioning member;

means for attaching said first positioning member to the upper surface of the rim;

a second positioning member; and means for attaching said second positioning member to the lower surface of the seat, said first and second positioning members being aligned such that they are cooperable when the seat is in the lowered position so as to prevent lateral movement of the seat relative to the rim.

2. The invention defined in claim 1 wherein each of said means for attaching includes an adhesive means.

3. The invention defined in claim 2 wherein each of said adhesive means is an adhesive tape.

4. The invention defined in claim 1 wherein one of said first and second positioning members is formed in the shape of a truncated cone.

5. The invention defined in claim 4 wherein the other of said first and second positioning members has a recess therein formed in the shape of a truncated cone.

6. A toilet comprising:

a bowl having an upper open end;

a rim formed about said upper open end of said bowl;

an upper surface of said rim being flat and circular in shape;

a seat pivotably secured to the bowl, said seat being movable to a lowered position wherein a lower surface thereof rests upon said upper surface of said rim;

a first positioning member attached to said upper surface of said rim; and a second positioning member attached to said lower surface of said seat, said first and second positioning members being aligned such that they are cooperable when the seat is in the lowered position so as to prevent lateral movement of the seat relative to the rim.

7. The invention defined in claim 6 wherein a plurality of said first positioning members are attached to said upper surface of said rim and a plurality of said second positioning members are attached to said lower surface of said seat.

8. The invention defined in claim 6 wherein the means of attaching said first and second positioning members to said rim and said seat, respectively, includes an adhesive means.

9. The invention defined in claim 8 wherein said adhesive means is an adhesive tape.

10. The invention defined in claim 6 wherein one of said first and second positioning members is formed in the shape of a truncated cone.

11. The invention defined in claim 6 wherein the other of said first and second positioning members has a recess therein formed in the shape of a truncated cone.

* * * * *